US005114112A

United States Patent [19]

Infanti

[11] Patent Number: 5,114,112

[45] Date of Patent: May 19, 1992

[54] DETACHABLE GAME STOOL ASSEMBLY

[75] Inventor: Vittorio Infanti, Matawan, N.J.

[73] Assignee: Infanti Chair Manufacturing Corp., Staten Island, N.Y.

[21] Appl. No.: 778,343

[22] Filed: Oct. 16, 1991

Related U.S. Application Data

[63] Continuation-in-part of Ser. No. 676,000, Mar. 26, 1991, Pat. No. 5,083,738.

[51] Int. Cl.[5] ..... A47B 97/00

[52] U.S. Cl. ..... 248/500; 297/174

[58] Field of Search ..... 248/500, 501, 510, 222.2, 248/680; 297/174

[56] References Cited

U.S. PATENT DOCUMENTS

| | | | |
|---|---|---|---|
| 459,844 | 9/1891 | Thomas | 182/92 |
| 3,664,628 | 5/1972 | Noble | 248/500 X |
| 4,840,343 | 6/1989 | Gasser | 297/174 X |
| 5,050,832 | 9/1991 | Lee et al. | 248/222.2 X |

*Primary Examiner*—Alvin C. Chin-Shue

*Attorney, Agent, or Firm*—Anthony J. Casella; Gerald E. Hespos

[57] ABSTRACT

An assembly is provided for detachably supporting a stool relative to a casino gaming machine comprising an elongated planar base member having an upturned portion at one end, a chair configuration extending from the base member opposite the upturned portion, and an extruded rigid support member fixed to the base of a gaming machine. The extruded rigid support member includes an upstanding base portion mountable to the gaming machine, a cantilevered portion and an angularly inclined portion which together define an engaging channel for receiving the upturned portion of the base member and for prohibiting longitudinal movement of the base member relative to the gaming machine. The support member further includes a pair of spaced apart rigid end stop members which extend downwardly from the cantilevered portion of the support member within the engaging channel for prohibiting lateral movement of the upturned portion of the base member relative to the gaming machine.

8 Claims, 3 Drawing Sheets

DETACHABLE GAME STOOL ASSEMBLY

CROSS REFERENCE TO RELATED APPLICATION

This application is a continuation-in-part of applicant's U.S. patent application Ser. No. 676,000, filed on Mar. 26, 1991, which application issued as U.S. Pat. No. 5083738 on Jan. 28, 1992. This application is also related to U.S. Pat. application Ser. No. 757,905, filed on Sept. 11, 1991, which application is a divisional of U.S. application Ser. No. 676,000.

BACKGROUND OF THE INVENTION

Casino gaming machines, and in particular slot machines, are often used by patrons for extended periods of time. It is therefore common place to provide the user of a gaming machine a chair or stool to ensure their comfort. However, chairs often become displaced to locations remote from their intended position adjacent the gaming machine. The dislocation of the chairs with respect to the gaming machines detract from the aesthetic appearance of the symmetric gaming machines, and may interfere with the flow of traffic in the casino. Thus, it is desirable to provide a means for attaching a chair to a casino gaming machine, such that the chair will not get displaced. However, it is also necessary, on a daily basis, to access a cash box generally located on the lower front surface of the gaming machine. Therefore, a chair that is fixed to a gaming machine must be provided with a means of disengagement such that an operator may easily access the cash box.

Prior art devices of this type have relied on a variety of different support configurations to space and secure a seat in relation to a gaming machine. One such prior art device comprises a flat base member having a fastening plate on one end disposed perpendicular to the plane thereof, and having an upstanding seat configuration adjacent the opposite end thereof. The fastening plate is provided with a plurality of bolt holes for fastening the base member to the base of a casino gaming machine. Moreover, the fastening plate, once bolted, is not readily removable from the base of the casino gaming machine. Therefore, in order to access the cash box located within the base of the gaming machine an attendant must position himself, in a crouched condition, between the gaming machine and the upstanding seat configuration so as to remove the coinage from the cash box.

U.S. Pat. No. 4,840,343 entitled "QUICK RELEASE SEAT SUPPORT" which issued to George E. Gasser on June 20, 1989 includes a flat body member having an upturned portion at one end and a chair configuration extending adjacent the opposite end thereof. The quick release seat support further includes an inverted U-shaped spring member which is fixed to the base of a casino gaming machine. The spring member includes an upright engagement portion having an outwardly extending flange portion with a downturned angularly inclined spring portion. In operation, the upturned portion of the flat body member is inserted into the elongated spring member such that the downturned angularly inclined spring portion deflects resiliently to allow registration of the upturned portion within the spring member. Thereafter, the downturned angularly inclined spring portion returns to its inwardly biased neutral position so as to apply a holding force against the upturned portion of the base member to resiliently inhibit movement of the base member within the spring member.

Inherent in the design of the quick release seat support disclosed in U.S. Pat. No. 4,840,343 are several shortcomings. Primarily, the angularly inclined spring portion is fragile and may, over time, lose its resilient quality thereby reducing the magnitude of the force that is necessary to inhibit the lateral movement of the upturned portion of the flat body member therein. This may occur as a result of mishandling of the chairs, or even from the constant body movements of game players. Furthermore, continual daily removal of the upturned portion of the flat body member from the spring member in order to access a cash box and subsequent reinsertion therein may cause the resilient material of the spring member to become fatigued and eventually the spring portion may fracture and break. Still further, should the spring portion become weakened or bent, it may not be possible to accurately align the gaming chairs configuration with the gaming machine. Thus, over time the asymmetric alignment of the gaming chairs may detract from the aesthetic appearance of the casino.

It is therefore an object of the subject invention to provide a detachable game stool assembly having a substantially rigid support member which will prohibit longitudinal and lateral movement of the base of the stool relative to the base of a casino gaming machine.

It is a further object of the subject invention to provide a detachable game stool assembly having a substantially rigid support member which will not deform as a result of repeated engagements with the base of the game stool.

It is a further object of the subject invention to provide a detachable game stool assembly having a rigid support member which will not weaken from a severe shock or vibrations caused by rough handling.

It is another object of the subject invention to provide a detachable game stool assembly which is inexpensive to manufacture.

It is still another object of the subject invention to provide a detachable game stool assembly including a support member which may be manufactured in an extrusion process so as to make the fabrication thereof simple and inexpensive.

SUMMARY OF THE INVENTION

The subject invention is directed to an assembly for detachably connecting a seat configuration to a casino gaming machine. The detachable game stool assembly of the subject invention basically comprises an elongated flat base member having an upturned portion at one end, a chair assembly secured to the base adjacent the end opposite the upturned portion, and a rigid support member fixed to the base of a casino gaming machine. The fixed support member is intended to prohibit longitudinal and lateral movement of the base member relative to the base of the casino gaming machine. The elongated base member and the rigid support member of the subject invention may be manufactured by extrusion techniques. In operation, the base member may be readily disengaged from the fixed support member to permit easy access to a cash box located inside the gaming machine.

The support member of the detachable game stool assembly of the subject invention comprises an elongated substantially rectangular base plate which is provided with spaced apart bolt holes for fastening the base plate to the base of the game machine. The support member further comprises rigid lateral retaining means which may be disposed perpendicular to the base plate of the support member or which may be disposed parallel to the base plate of the support member to prohibit lateral movement of the upturned portion of the base member relative to the game machine. The rigid lateral retaining means may be cylindrical rods or rectangular beams disposed is spaced apart relationship.

The support member further comprises rigid longitudinal retaining means attached to the base plate to prohibit longitudinal movement of the upturned portion of the base member relative to the base of the casino gaming machine. The longitudinal retaining means may be one or more substantially rectangular planar beams disposed in spaced apart parallel relationship with the base plate of the support member to form a generally rectangular engagement slot therebetween for positively receiving and releasably retaining the upturned portion of the base member of the game stool assembly.

In a preferred embodiment of the subject invention the elongated support member of the game stool assembly comprises an elongated extrusion having an inverted J-shaped cross-section. More particularly, the inverted J-shaped cross-section is defined by an upstanding leg mountable to the game machine, an outwardly extending arm disposed perpendicular to the upstanding leg and an outwardly angled leg extending downwardly from the arm to define an engaging channel with a guided entry for receiving the upturned engaging portion of the base member. In addition, the support member includes a pair of spaced apart rigid end stop members disposed within the engaging channel and extending downwardly from the arm. The end stop members function to prohibit lateral movement of the base member relative to the game machine.

Furthermore, in a preferred embodiment of the subject invention the base member of the game stool assembly would include beveled lateral edges for preventing patrons from tripping when walking proximate to the seat configuration. Additionally, the base member may be provided with a plurality of elongated striations disposed in spaced relationship on the upper surface thereof for preventing patrons from slipping when entering and exiting the seat configuration.

In summary, a detachable game stool assembly is provided comprising an elongated base member having an upturned portion at one end and having an upstanding seat configuration adjacent the opposite end thereof, a rigid support member fixed to the base of a casino gaming machine for engaging the upturned portion of the elongated base member so as to prohibit longitudinal and lateral movement of the base member relative to the casino gaming machine.

DETAILED DESCRIPTION OF THE PREFERRED EMBODIMENTS

Figure 1:
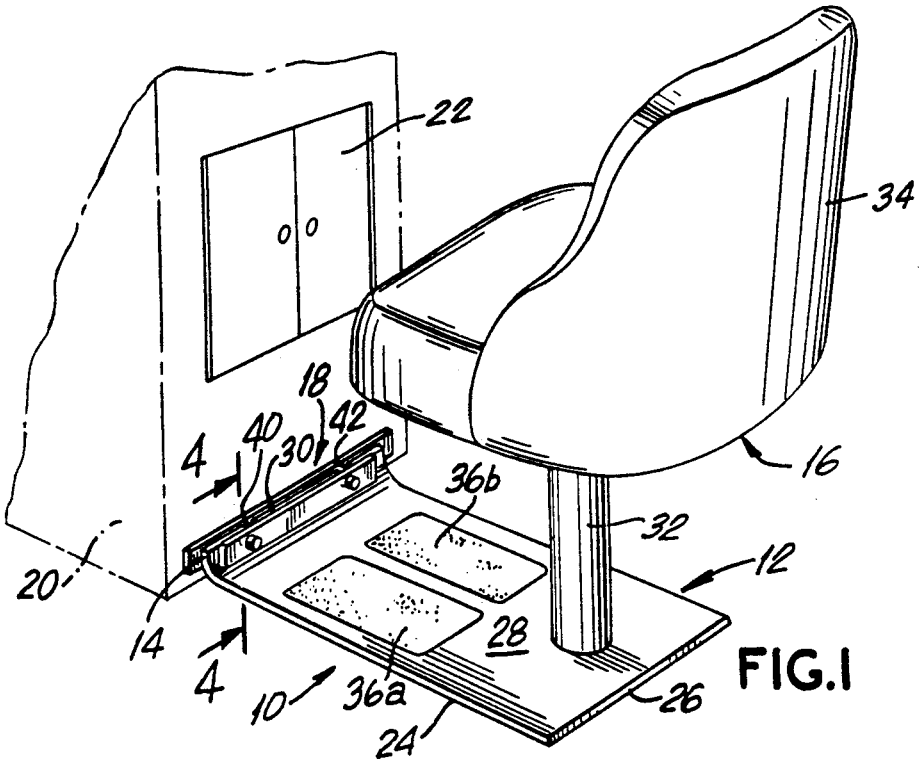
FIG. 1 is a perspective view of the detachable game stool assembly of the subject invention.
Figure 2:
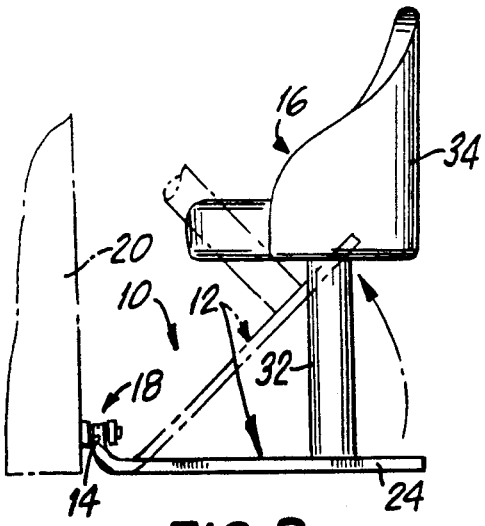
FIG. 2 is a side elevational view of the detachable game stool assembly of the subject invention.

The detachable game stool assembly of the subject invention is illustrated in FIG. I and is designated generally by reference numeral 10. The detachable game stool assembly 10 of the subject invention basically comprises an extruded elongated flat base member 12 having an upturned portion 14 at one end, a chair configuration 16 extending from the base member opposite the upturned portion 14, and a rigid support member 18 fixed to the base of a gaming machine 20 having a cash box 22. The upturned portion 14 of the base member 12 may be detached from the rigid support member 18 such that an attendant may have easy access to the cash box 22 in the gaming machine 20, as illustrated in FIG. 2.

The extruded base member 12 of the detachable game stool assembly 10 of the subject invention comprises an elongated flat portion 24 having a rear edge 26 and having an upper surface face 28. The base member 12 is formed with upturned engaging portion 14 extending perpendicular to the plane thereof having a distal edge 30. An upstanding seat configuration 16 is secured to the base member 12 adjacent the rear edge 26 thereof. The seat configuration 16 includes a cylindrical post 32 with a cushioned seat 34 secured thereto. The upper surface face 28 of the flat portion 24 of the base member 12 is provided with a pair of generally rectangular non-slip traction pads **36*a* and 36*b* disposed in spaced apart relationship intermediate post 32 of the seat configuration 16 and the upturned engaging portion 14. The traction pads 36*a* and 36*b* are provided to prevent a user from slipping upon standing up from the seat 34. Alternatively, referring to FIG. 3, the elongated flat portion 24 of the base member 12 may include a plurality of striations 38*a* and 38*b* disposed in spaced apart relationship parallel to the longitudinal axis of the elongated flat portion 24. The striations 38*a* and 38*b* are provided to prevent a user form slipping upon standing up from the seat 34. The upturned portion 14 of the base member 12 is provided with a pair of spaced apart semi-circular engaging notches 40 and 42. The engaging notches 40 and 40 are disposed in distal edge 30 of the upturned portion !4 of the base member 12**.

One embodiment of the rigid support member 18 of the detachable game stool assembly 10 of the subject invention includes a pair of rigid parallel generally rectangular beams 44 and 46 connected in spaced apart relationship to one another by a pair of cylindrical rods 48 and 50 to form an engagement slot 52 therebetween. The cylindrical rods 48 and 50 are spaced apart to correspond with the spacing of the notches 40 and 42 disposed in distal edge 30 of the upturned portion 14 of the base member 12. Rectangular beam 44 includes a pair of spaced apart bolt holes 54 and 56 for fastening support member 18 to the base of the gaming machine 20.

Figure 3:
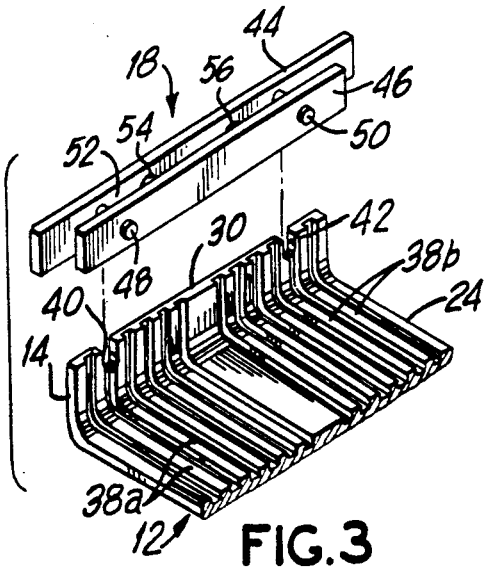
FIG. 3 is a perspective view of a portion of the detachable game stool assembly of the subject invention illustrating the fixed support member.
Figure 4:
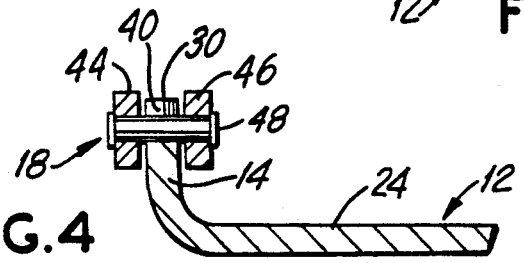
FIG. 4 is a cross-sectional view taken along line 4-4 of FIG. 1 illustrating the inter-engagement of the base member and the fixed support member of the detachable game stool assembly of the subject invention.

Referring to FIGS. 3 and 4., to install the detachable game stool assembly 10 of the subject invention, the upturned portion 14 of the base member 12 is inserted between the parallel beams 44 and 46 of the rigid support member 18 of the detachable game stool assembly 10 such that the cylindrical rods 48 and 50 are in registration with the notches 40 and 42. At such a time, the intimate registration of the notches 40 and 42 with the cylindrical rods 48 and 50 prohibits lateral movement of the base member 12 of the detachable game stool assembly 10 relative to the base of the gaming machine 20. Furthermore, the rigid rectangular beam 44 of the fixed support member 18 prohibits longitudinal movement of the base member 12 of the detachable game stool assembly 10 relative to the base of the gaming machine 20.

Referring to FIG. 2, the base member 12 of the detachable game stool assembly 10 may be tilted such that the upturned portion 14 disengages the rigid support member 18. Thereafter, the entire seat configuration may be moved to a location remote from the gaming machine 20 such that an operator may easily access the cash box 22 located in the gaming machine 20. Subsequently, the upturned portion 14 of the base member 12 of the detachable game stool assembly 10 may be reinserted into the rigid support member 18.

Figure 5:
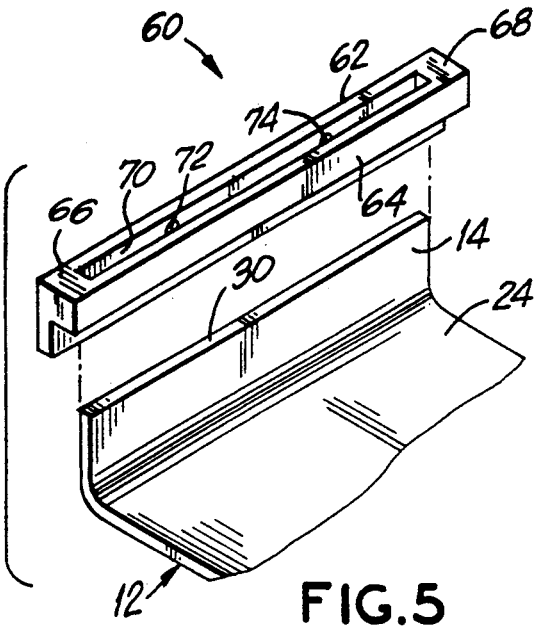
FIG. 5 is a perspective view of a second embodiment of the fixed support member of the detachable game stool assembly of the subject invention.

Turning to FIG. 5, an alternate embodiment of the rigid support member of the subject invention is illustrated and is generally designated by reference numeral 60. The rigid support member 60 comprises a unitary member having a pair of elongated generally rectangular rigid support beams 62 and 64, rigidly connected to one another by a pair of rigid end stops 66 and 68 to form a generally rectangular engagement slot 70 therebetween. Support beam 62 includes a pair of spaced apart bolt holes 72 and 74 for fastening support member 60 to the base of the gaming machine 20.

Figure 6:
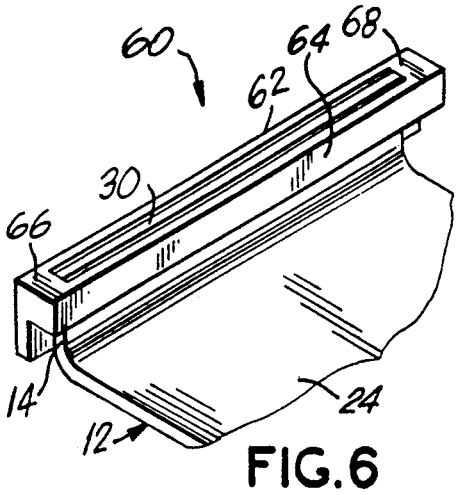
FIG. 6 is a perspective view of the second embodiment of the fixed support member of the detachable game stool assembly of the subject invention.

Turning to FIG. 6, in operation, the upturned portion 14 of the base member 12 of the detachable game stool 10 may be secured in the generally rectangular engagement slot 70 of the rigid support member 60. At such a time, the rigid support member 70 effectively prohibits longitudinal and lateral movement of the base member 12 relative to the base of the gaming machine 20.

Figure 7:
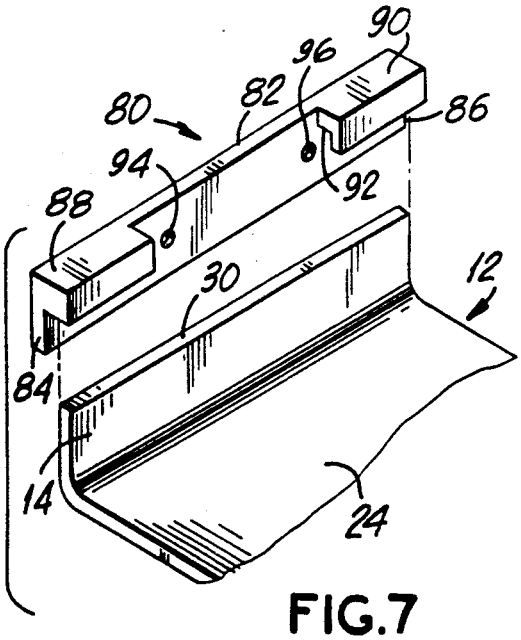
FIG. 7 is a perspective view of a third embodiment of the fixed support member of the detachable game stool assembly of the subject invention.

Referring to FIG. 7, a third embodiment of the rigid support member of the subject invention is illustrated and is designated generally by reference numeral 80. The rigid support member 80 comprises an elongated flat beam 82 having distal edges 84 and 86. The rigid support member further comprises a pair of spaced apart generally L-shaped rigid channel beams 88 and 90 disposed adjacent distal ends 84 and 86 thereof, respectively, to form a generally rectangular engagement slot 92 therebetween. Flat member 82 includes a pair of spaced apart bolt holes 94 and 96 for fastening support member 80 to the base of the gaming machine 20.

Figure 8:
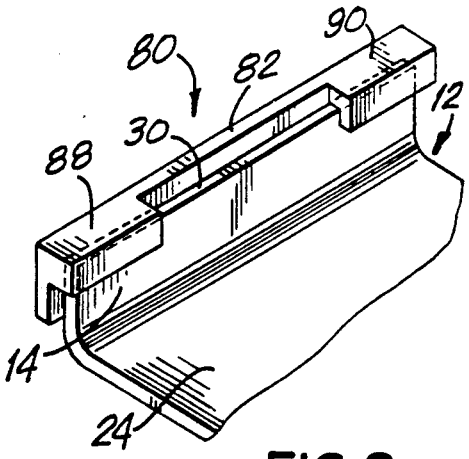
FIG. 8 is a perspective view of the third embodiment of the fixed support member of the detachable game stool assembly of the subject invention.

Turning to FIG. 8, in operation, the upturned portion 14 of the base member 12 of the detachable game stool 10 may be secured in the generally rectangular engagement slot 92 of the rigid support member 80. At such a time, the rigid support member 80 effectively prohibits longitudinal and lateral movement of the upturned portion 14 of the base member 12 relative to the base of the gaming machine 20.

Figure 9:
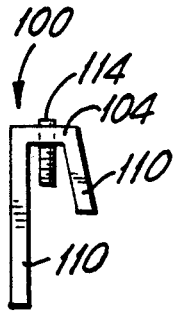
FIG. 9 is a side elevational view of a fourth embodiment of the fixed support member of the detachable game stool assembly of the subject invention.
Figure 10:
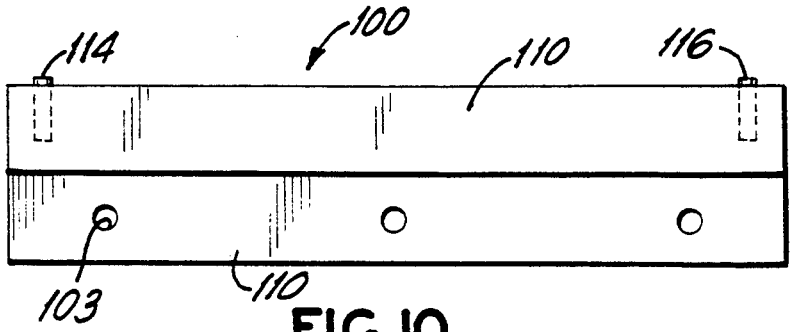
FIG. 10 is a front elevational view of the fourth embodiment of the fixed support member of the detachable game stool assembly of the subject invention.
Figure 11:
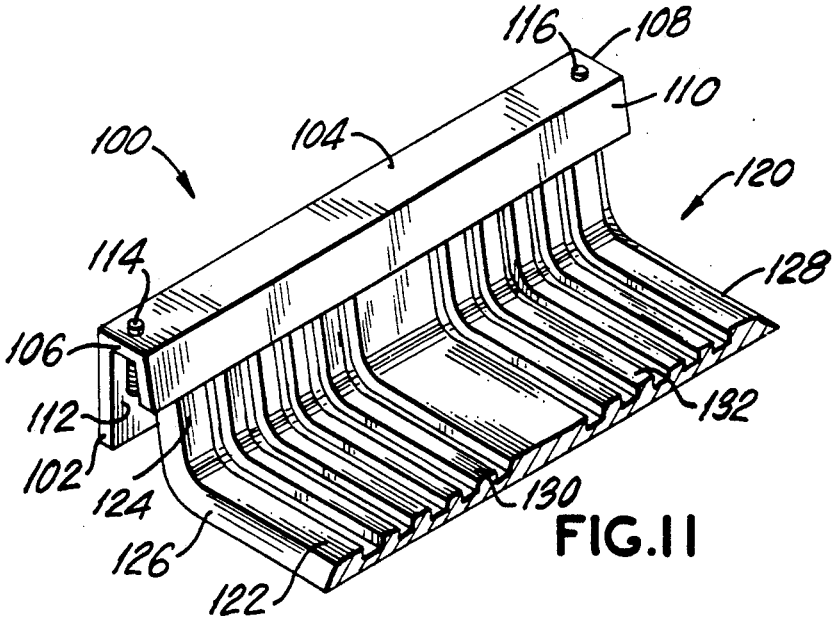
FIG. 11 is a perspective view of the fourth embodiment of the fixed support member of the detachable game stool assembly of the subject invention.

Turning to FIGS. 9 through 11, a preferred embodiment of the rigid support member and the elongated base member of the subject invention is illustrated and is designated generally by reference numeral 100. The rigid support member 100 comprises an elongated upstanding planar rear base portion 102 having a plurality of spaced apart bolt receiving apertures 103, a cantilevered portion 104 having opposed ends 106 and 108 and which extends outwardly from and perpendicular to the base portion 102 and a rigid front retaining portion 110 which extends angularly and downwardly away from the cantilevered portion 104 with respect to the base portion 102 to form an elongated engaging channel 112 having an inverted J-shaped cross-section. The engaging channel 112 functions to receive and releasably retain the upturned portion 124 of a base member 120 of the detachable game stool assembly 10 of the subject invention. Moreover, the angular inclination of the front retaining portion 110 of the rigid support member 100 may be between 10° and 20° relative to the base portion so as to define a guided entry to enable quick and easy releasable engagement of the upturned portion 124 of the base member 120.

It is apparent that the generally J-shaped cross-sectional design and the unitary construction of the rigid support member 100 makes it an extremely desirable embodiment of the subject invention. Moreover, it may be efficiently manufactured by extruding 0.25" aluminum stock through a die. In doing so, the support member 100 of the subject invention would be extremely inexpensive to fabricate.

The rigid support member 110 of the subject invention further comprises an elongated first end stop member 114 which is rigidly fastened in the cantilevered portion 104 of support member 100 and which is spaced a small distance from the end 106 thereof. The rigid end stop member 114 extends downwardly into the engaging channel 112 parallel to the base portion 102 of the support member 100. In addition, the support member 100 comprises a second elongated rigid end stop member 116 which is rigidly fastened in the cantilevered portion 104 and which is spaced a small distance from the end 108 thereof. The rigid end stop member 116 extends downwardly into the engaging channel 112 parallel to the base portion 102 of the support member 100 and is aligned with the first end stop member 114.

To assemble the rigid support member 110 of the subject invention a hole is drilled and taped a small distance from each end 106 and 108 of the cantilevered portion 104. At such a time the rigid end stop members 114 and 116 may be fastened in the engaging channel 112 by being threadably engaged in the cantilevered portion 104 of the support member 110, or the end stop members 114 and 116 may be staked into the cantilevered portion 104 from within the engaging channel 112 so that they are not noticeable from the top of the support member 100.

Referring to FIG. 11 an alternative embodiment of the base member of the detachable game stool assembly 10 of the subject invention is illustrated and is designated generally by reference numeral 120. The base member 120, which is preferably fabricated in an extrusion process, includes an elongated flat portion 122 and an upturned engaging portion 124 at one end thereof. In particular, the elongated flat portion 122 and the upturned portion 124 of the base member 120 may be provided with beveled lateral edges 126 and 128. The beveled lateral edges 126 and 128 have a two fold purpose. First the beveled edges 126 and 128 on the flat portion 122 of the base member would eliminate the risk of patrons tripping over the base member 120 when walking proximate to the chair configuration 16. Second, the beveled edges 126 and 128 on the upturned portion 124 of the base member 120 function to cooperate with the end stop members 114 and 116 in the engaging channel 112 in such a manner as to nest, respectively, with each other upon engaging the upturned portion 124 of the base member 120 within the support member 100. In addition, the base member 120 is provided with first and second spaced apart sets of elongated striations 130 and 132 which are disposed parallel to the longitudinal axis of the base member 120 along the entire length thereof. The spaced apart sets of striations 130 and 132 function to prevent patrons from slipping on the base member 120 when approaching and/or leaving the seat configuration 16 of the game stool assembly 10 of the subject invention and in addition prevents slipping when the patrons are pulling on the gaming arms of the slot machine.

In operation, when the upturned portion 124 of the base 120 is releasably retained within the engagement channel 112, the rigid end stop members 114 and 116 function to prohibit lateral movement of the upturned portion 124 of the base member 120 relative to the casino gaming machine 20.

While the invention has been described with respect to several embodiments, it is apparent that a variety of changes may be made without departing from the scope of the invention as defined by the appended claims.

I claim:

1. A detachable game stool assembly for releasable connection to a game machine, said assembly comprising:

an elongated base member having opposed front and rear edges, opposed lateral edges, an upper surface, a planar portion extending forwardly from the rear edge, said front edge of said base member being upturned to form an engaging portion generally perpendicular to the planar portion of said base;

an upstanding seat configuration secured to the planar portion of said elongated base member;

an extruded generally inverted J-shaped rigid support member, said support member having a substantially planar upstanding leg fixed to the game machine and having a top and a bottom, an arm extending outwardly from the top of the leg, a rigid front inclined leg extending outwardly downward from said arm to define an engaging channel with a guided entry for receiving the upturned engaging portion of the base member, said rigid inclined leg and said upstanding leg of the support member prohibiting longitudinal movement of the upturned portion of the base member of said assembly relative to said game machine; and a pair of elongated rigid rods fixed to the arm of the support member and disposed in spaced apart relationship, said rigid rods extending downwardly from said arm within said engaging channel for prohibiting lateral movement of the upturned portion of the base member relative to the game machine.

2. A detachable game stool assembly as recited in claim 1 wherein the rigid rods are disposed parallel to the upstanding leg of the extruded rigid support member.

3. A detachable game stool assembly as recited in claim 1 wherein the angle of inclination of the inclined leg of the extruded rigid support member is between 10° and 20° relative to the upstanding leg of the rigid support member.

4. A detachable game stool assembly as recited in claim 1 wherein the angle of inclination of the inclined leg of the extruded rigid support member is 10° relative to the upstanding leg of the rigid support member.

5. A detachable game stool assembly as recited in claim 1 wherein, the extruded rigid support member is aluminum.

6. A detachable game stool assembly as recited in claim 1 wherein the opposed lateral edges of the elongated base member are angled inwardly toward one another so as to define a ramp along each of the opposed lateral edges.

7. A detachable game stool assembly as recited in claim 1 wherein the elongated base member is provided with a plurality of elongated striations disposed in spaced apart relationship on the upper surface thereof.

8. A detachable game stool assembly as recited in claim 1 wherein the plurality of elongated striations include first and second sets of elongated striations.

* * * * *